US005371908A

United States Patent [19]

Secondine

[11] Patent Number: 5,371,908

[45] Date of Patent: Dec. 13, 1994

[54] ANTI-SPLASH ATTACHMENT ASSEMBLY FOR A SHOWER CURTAIN ROD

[76] Inventor: Bryce Secondine, 3130 S. 214th East Ave., Tulsa, Okla. 74014

[21] Appl. No.: 199,583

[22] Filed: Feb. 22, 1994

[51] Int. Cl.[5] ..... A47K 3/22

[52] U.S. Cl. ..... 4/609

[58] Field of Search ..... 4/608, 609, 610, 558

[56] References Cited

U.S. PATENT DOCUMENTS

| | | | |
|---|---|---|---|
| 2,923,013 | 2/1960 | Wasserman | 4/610 |
| 4,769,862 | 9/1988 | Skrzelowski | 4/609 X |
| 4,944,050 | 7/1990 | Shames et al. . | |
| 5,189,759 | 3/1993 | Poore | 4/608 X |
| 5,216,766 | 6/1993 | Lang | 4/609 |

*Primary Examiner*—Charles E. Phillips
*Attorney, Agent, or Firm*—C. Dale Quisenberry; William S. Dorman

[57] ABSTRACT

An anti-splash attachment assembly for a shower curtain rod is provided to prevent shower water from splashing from the shower area onto the bathroom floor. The assembly comprises a curved tubular member and a fastening sleeve. The fastening sleeve is provided to secure the curved member to the end of a shower curtain rod nearest the shower nozzle. The curved member is attached to the rod so that a shower curtain hanging from the curved member will follow the inner contour of a bathtub.

2 Claims, 1 Drawing Sheet

ANTI-SPLASH ATTACHMENT ASSEMBLY FOR A SHOWER CURTAIN ROD

FIELD OF THE INVENTION

The present invention relates to bathroom improvement devices, and more particularly to a device for preventing shower water from splashing away from the shower area onto the bathroom floor.

THE PRIOR ART

It is well known that humans normally bath either by sitting down in a bathtub filled with water (i.e. "taking a bath"), or by standing up in a bathtub in front of a stream of water flowing from a shower nozzle (i.e. "taking a shower"). When taking a shower, it is also well known that a barrier of some sort (normally either a shower curtain or a sliding door) is necessary to keep the water inside the bathtub instead of splashing off the human onto the bathroom floor.

Unfortunately, when the barrier is a shower curtain, there is still a chance for some of the water to escape onto the bathroom floor. If the shower curtain is not completely pulled up against the shower wall to which the shower nozzle is mounted, there will be a space through which the water can splash out of the bathtub area and into the rest of the bathroom. This happens because the top of the shower curtain follows the curtain rod which runs straight up against the shower wall, but the bottom of the shower curtain follows the inner contour of the bathtub which curves inwardly. Consequently, the bottom of the shower curtain tends to pull the rest of the shower curtain away from the shower wall, thereby creating an avenue through which some of the shower water can splash out into the bathroom.

For obvious reasons, it is undesirable for shower water to splash out of the bathtub area onto the bathroom floor. Indeed, it can be an annoying occurrence to walk around with bare feet on a cold, wet bathroom floor. In addition, if the bathroom floor is uncarpeted, the water should be mopped up. Alternatively, if the floor is carpeted, the carpet could become soiled. Moreover, in either case, the possibility exists for the water to cause serious structural damage to the house. If the water seeps into the wooden structure of the house, the wood will eventually rot. Needless to say, this could ultimately lead to an expensive repair bill.

One way to address the shower splash problem is disclosed in Shames et al. U.S. Pat. No. 4,944,050, which shows a combined shower splash guard and shower curtain holder. However, the present invention, as more fully described below, represents a completely new and different solution to the shower splash problem.

SUMMARY OF THE INVENTION

The present invention is directed to a device that solves and satisfies the above-explained problem by providing a new approach to preventing shower water from escaping the shower area. In more particular, it has been discovered that the heretofore "straight" shower curtain rod can be modified by securing an anti-splash attachment assembly to the end of the rod nearest the shower nozzle so that the shower curtain hanging from the modified rod will follow the interior contour of a bathtub inwardly toward the bathtub drain. Consequently, no space is left for the water to splash out of the bathtub area onto the bathroom floor.

The attachment assembly of the present invention comprises a curved tubular member and a fastening sleeve. The fastening sleeve is provided to secure the curved tubular member to the shower rod such that the curved tubular member extends inwardly toward the shower nozzle. The tubular member may be provided with a plurality of grooves about its periphery for maintaining the position of a shower ring hanging therefrom.

These and other features, aspects and advantages of the present invention will become evident from the following detailed description, appended claims, and accompanying drawings.

DETAILED DESCRIPTION OF THE PREFERRED EMBODIMENT

Figure 1:
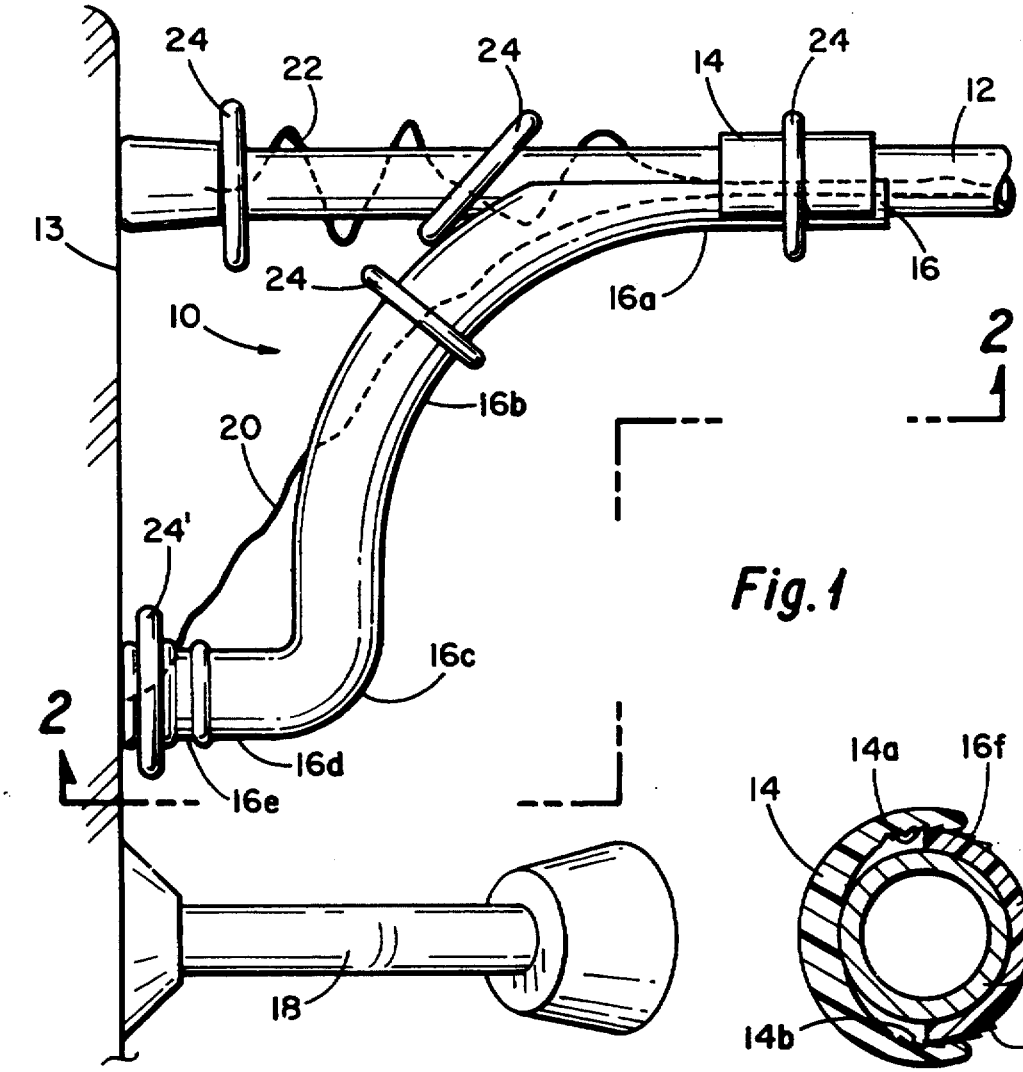
FIG. 1 is a top plan view of the attachment assembly of the present invention shown securely fastened to a shower curtain rod and in close proximity to a shower nozzle.
Figure 2:
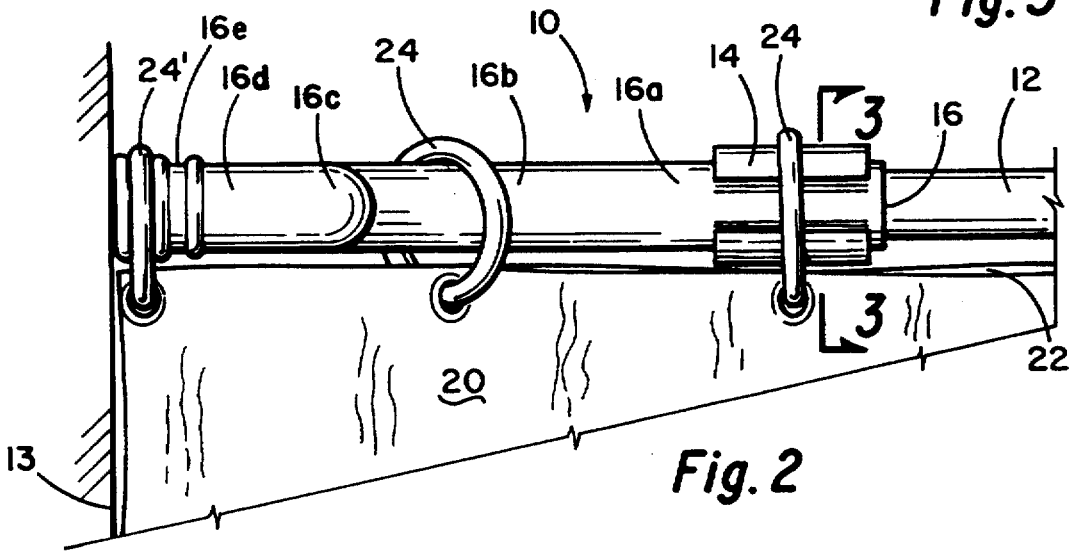
FIG. 2 is a side elevation of the attachment assembly of the present invention as shown in FIG. 1.

Referring to the drawings in detail, wherein like numerals denote identical elements throughout the several views, there is shown in FIGS. 1 and 2 the attachment assembly of the present invention 10 securely fastened to a shower curtain rod 12, both of which are securely held against a shower wall 13. The assembly 10 comprises a fastening sleeve 14 and a curved tubular member 16. The fastening sleeve 14 is provided to secure the curved tubular member 16 to the shower curtain rod 12. As best shown in FIG. 1, the curved member 16 extends inwardly from the rod 12 toward a shower nozzle 18. An inner shower curtain 20 and an outer shower curtain 22 hang from rings 24 which are attached to the shower curtain rod 12 and the curved tubular member 16. The outer curtain 22 hangs only from the rod 12, whereas the inner curtain 20 hangs from both the rod 12 and the tubular member 16 so that the inner curtain 20 curves inwardly toward the shower nozzle 18 and rests against the inner contour of a bathtub (not shown).

Figure 3:
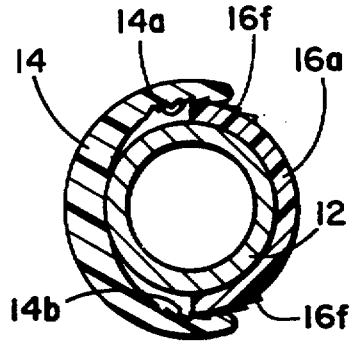
FIG. 3 is cross section illustrating how a fastening sleeve is used to secure a curved tubular member to a shower curtain rod.

The curved tubular member 16 has, in a horizontal plane, a straight shower curtain rod mating section **16*a*, a curved section 16*a*, a right angle elbow section 16*c*, and a straight short section 16*d*. As best shown in FIG. 3, the mating section 16*a* has a C-shaped cross section with a radius sufficient to closely surround the shower curtain rod 12. Referring back to FIG. 1, the curved section 16*b* is in the shape of a quarter section of a circle, the radius of the circle being substantially identical to the inner contour of a corner of a bathtub (not shown). The short section 16*d* is offset from and parallel to the mating section 16*a*. The curved section 16*b* forms a 90 degree bend between the mating section 16*a* and the elbow section 16*c*. The elbow section 16*c* is between the curved section 16*b* and the short section 16*d* so that the elbow section 16*c* and the curved section 16*b* bend in opposite directions. The short section 16*d* may be provided with a plurality of grooves 16*e* to maintain the position of a shower ring 24' and to thereby hold the inner curtain 20 closely adjacent the shower wall 13**.

As shown in FIG. 3, the fastening sleeve 14 has a horseshoe-shaped cross section with a radius sufficient to allow it to closely surround the mating section 16*a* of the curved tubular member 16 when the sleeve 14 and the mating section 16*a* are placed opposite one another around the shower curtain rod 12. The sleeve 14 has gripping groove areas 14*a* and 14*b* on its inner surface to assist the sleeve 14 in holding the mating section 16*a* securely against the shower curtain rod 12 via gripping ridges 16*f*.

Whereas, the present invention has been described in particular relation to the drawings attached hereto, other and further modifications, apart from those shown or suggested herein, may be made within the spirit and scope of this invention.

What is claimed is:

1. An attachment assembly for a shower curtain rod comprising:

a curved tubular member and a fastening sleeve, said tubular member having in a horizontal plane a straight shower curtain rod mating section, a curved section, a right angle elbow section and a straight short section, said mating section having a C-shaped cross section, said C-shaped section having an interior radius sufficient to closely surround a shower curtain rod and having one of gripping grooves and gripping ridges on an outer surface at both ends of the c-shaped section, said curved section being in the shape of an arc section of a circle, the radius of said circle being substantially identical to the inner contour of a corner of a bathtub, said short section being offset from and parallel to said mating section, said curved section extending between said mating section and said elbow section, said elbow section being between said curved section and said short section so that said elbow section and said curved section bend in opposite directions, said fastening sleeve having an inner surface provided with two gripping sections comprising one of said gripping grooves and said gripping ridges on opposite ends thereof, said sleeve having a horseshoe-shaped cross section, said horseshoe-shaped section having a radius sufficient to allow said gripping sections to closely surround said mating section when said sleeve and said mating section are placed opposite one another around a shower curtain rod with said one of said gripping grooves and said gripping ridges of said mating section engaging the, said tubular member being attachable to a shower curtain rod so that said short section is located against a shower wall in close proximity to a shower nozzle.

2. An attachment assembly for a shower curtain rod as recited in claim 1 wherein said short section is provided with a plurality of radial grooves about its periphery for maintaining the position of a shower curtain ring.

* * * * *